United States Patent [19]

Wolter

[11] Patent Number: 4,584,858

[45] Date of Patent: Apr. 29, 1986

[54] DEVICE FOR FORMING A BUNCH OF KEYS

[76] Inventor: Heinz Wolter, Meiswinkel 3, 5067 Kürten, Fed. Rep. of Germany

[21] Appl. No.: 514,478

[22] Filed: Jul. 18, 1983

[30] Foreign Application Priority Data

Jul. 17, 1982 [DE] Fed. Rep. of Germany ..... 3226837

[51] Int. Cl.[4] ..... A44B 15/00; A45C 11/32; A47G 29/10

[52] U.S. Cl. ..... 70/456 R; 24/116 A; 24/643; 70/459

[58] Field of Search ..... 70/456 B, 456 R, 459; 24/116 A, 490–492, 643–645, 652–654

[56] References Cited

U.S. PATENT DOCUMENTS 2,737,046 3/1956 Jancsics .
2,821,003 1/1958 Boyes ..... 24/645
3,181,321 5/1965 Gits ..... 70/456 R
3,257,696 6/1966 Miller et al. .
3,608,343 9/1971 Kimel .
4,450,604 5/1984 Oowada ..... 24/652

FOREIGN PATENT DOCUMENTS 1125991 11/1956 France .
1200546 12/1959 France .

*Primary Examiner*—Kenneth J. Dorner
*Assistant Examiner*—Russell W. Illich
*Attorney, Agent, or Firm*—Martin A. Farber

[57] ABSTRACT

A device for forming a bunch of keys having a centrally arranged disc from which individual key holder members extend. Ball heads of arms of the key holder members are slidably mounted in an undercut groove in the disc which opens towards the periphery of the disc. The groove has a removal opening for the ball heads which is releasably closed by a slide such that the ball heads can move around in the groove passing by the removal opening.

23 Claims, 24 Drawing Figures

DEVICE FOR FORMING A BUNCH OF KEYS

The present invention relates to a device for forming a bunch of keys, having a centrally arranged disc from which individual key-holder members extend, in the manner that heads of arms of the key-holder members are slidingly supported in an undercut groove which opens towards the circumference of the disc.

One device of this kind is known from French Pat. No. 1,200,546. In that case the disc is formed of two groove-forming halves which are riveted together at the center. It contains from the very start a given number of key-holder members which can gradually be equipped as necessary with individual keys. This is done by means of a latch device which is arranged on that end of the key-holder members which is opposite a ball head. This latch device consists of a shaft which can be connected in the manner of a ball joint to the arm. The shaft is slit longitudinally up to its dome-like cover part into which a second ball head located opposite the ball head on the disc side can be inserted. A displaceable locking sleeve is associated with the shaft. The sleeve cooperates with a holding ring which terminates in legs which are under a spreading force and can be inserted into the shaft, one of said legs having a holding projection which passes through an opening in the shaft. The holding projection protrudes under spring force in front of one end of the safety sleeve while the other end thereof lies against the holding ring. By pushing the projection inwards the locking sleeve can be separated from the shaft. In this way, the ring is also opened in order to attach or remove the individual keys. Means of this kind are relatively expensive. They have the disadvantage in use that the disc is provided in advance with the key-holder members. On the one hand, the device is thereby made unnecessarily large if only a given small number of keys is to be combined into a bunch while, on the other hand, there is no possibility of effecting an addition of key-holder members as might become necessary.

The object of the present invention is to develop a device of this type for the formation of a bunch of keys in a manner which is simple to manufacture and more advantageous in use, in such a way that the user is provided with the possibility of at any time adding individual key-holder members and thus also of conveniently effecting an exchange of keys (for instance automobile key, house key).

This object is achieved in the manner that the groove (2) has a removal opening (O) for the heads (4), which opening is releasably closed by a slide such that the ball heads can move around in the groove passing by the removal opening.

As a result of this development, a device of this type of increased value in use for the formation of a bunch of keys is obtained. The number of keys can at any time be rapidly and conveniently increased or, if necessary, reduced. It is no longer necessary to retain on the disc unused key-holder members which unnecessarily increase the size or the weight of the bunch of keys.

The device can therefore be more easily carried along with one. For this purpose, the groove which opens towards the circumference of the disc has simply a slide-closed removal opening for the ball heads. The central region of the disc surrounded by the annular groove which is in any event present is favorably available for the provision of a suitable slide. One structurally advantageous solution is that the slide (Sch) leaves a passage cross-section for the ball head (4) which corresponds at least to the cross-section of the ball head (4) and over which there extends, towards the outside, at least one flank (15') of the slide (FIG. 7). This provides for continuous circumferential travel of the ball heads. The slide (Sch) can, however, in favorable fashion also be developed as a rotary slide. In this case it is proposed, from a structural standpoint, that the rotary slide (Sch), arranged as a radially projecting pin (30), have in the region of its inner end a bayonet-closure-like locking recess (31) and be developed with the section thereof (30") protruding beyond the peripheral surface of the disc as an operating handle (19).

The rotary slide (Sch) has an undercut channel (33, 34) which can be brought into a transverse position with respect to the groove (2) with the end of the channel in the transverse position (FIGS. 15 and 16), in front of a removal cross-section (such as removal opening O) in the region of the circumferential surface of the disc. This solution is of particular advantage since, with free rotation of the slide also in this case, all other key-holder members are blocked from being inserted or removed during the addition or removal of a member.

One favorable arrangement of the slide for exclusively linearly displaceable slides is a slide (Sch) which is displaceable radially relative to the disc (1) and has an actuating handle (19) exposed at the wide side of the disc in the central region of the disc. This makes convenient one-hand operation possible.

In this connection it is furthermore structurally advantageous for the slide (Sch) to be located in the region of a widening in the cross section (24) of the groove (2) and to form a jaw (head 13) which engages into the region of the groove (2) and has a jaw opening formed as a partial section (2') of the groove (2). This has the advantage, in this case also, of a completely freely movable rotation and peripheral sliding of the key holder members. In order to obtain convenient actuation of the slide without having to tolerate an exposed projecting position, it is furthermore advantageous for the free end of the operating handle (19) to be countersunk in a dish-shaped recess (37) formed on the wide side of the disc. It is thus definitely necessary for one to intentionally grasp the free end of the operating handle. As a result of the feature that the slide (Sch) is tiltable upon its pull-back movement (FIG. 8) over a blocking shoulder (25) of the disc (1) or of insert member (17), the linear path of actuation of the slide is interrupted by a transverse movement. This makes a slide-push movement necessary.

The slide support (16) is formed by an insert part (17) which is snapped or clipped transversely into the disc (1). The insert part may be shaped so as to serve as an attachment means for the two disc halves. On the other hand, a direct screw attachment or an attachment of the two disc halves by means of fastening screws is also favorable. Furthermore, one feature which serves for reliability in use is that the slide (Sch) be spring biased into the closed position. Exact control of the movement of the slide is obtained by structurally simple means by a deflection and respectively alignment incline (26 and respectively 13''') which is directed counter to the tilting movement of the slide being associated with the head (13) of the slide. A support for the slide which favors the corresponding tilting is obtained by the rear end of the slide spring (12) resting against a ball (28), which is arranged in a recess (23) of the disc (1), which recess is adjacent a guiding surface (27). In this way the blocking position of the slide is guaranteed essentially by spring force. The spring body in both end positions is also provided with an alignment such that it acts always in the correct manner. It is furthermore advantageous for the ball guiding surface (27) to drop down obliquely to the recess (23) and for the blocking shoulder (25) together with the slide end (13') to be at approximately the height of the center of the ball. In practice, this effects a blocking position maintained by the cooperating shape of the parts themselves. The ball lies in front of the blocking shoulder as an "obstacle" which can only be intentionally overcome. The blocking action is optimized if the flank (25') of the step on the slide-support side extends in the same plane as the inner flank (13'') of the slide end (13') developed as a tongue (2) in the basic position of the slide (FIG. 10*b*). The ball thus lies closely in front of the tongue or even rests against it.

Furthermore the disc (1) can be formed of two halves which are screwed together along the central plane (z—z) of the disc.

With the above and other objects and advantages in view, the present invention will become more clearly understood in connection with the detailed description of several preferred embodiments, when considered with the accompanying drawings, of which:

Figure 10:
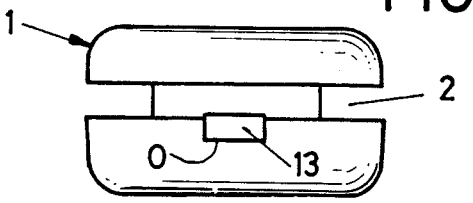
FIG. 10 is a top view of this device.
Figure 10A:
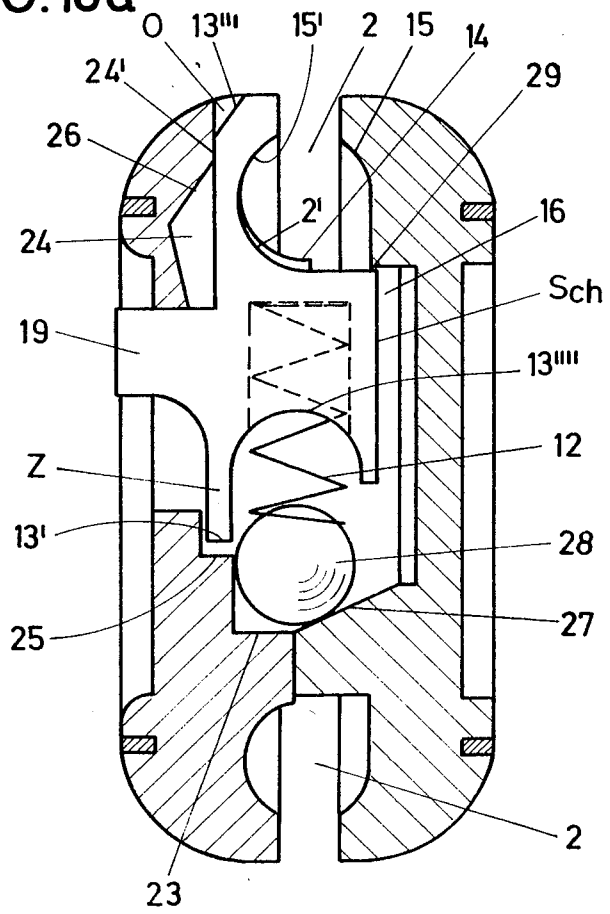
Figure 10B:
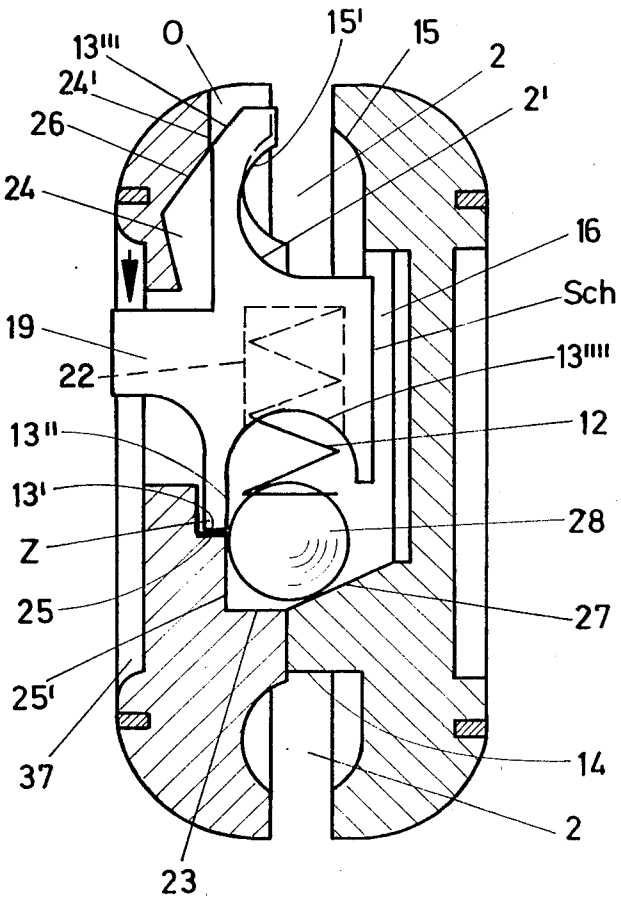
Figure 10C:
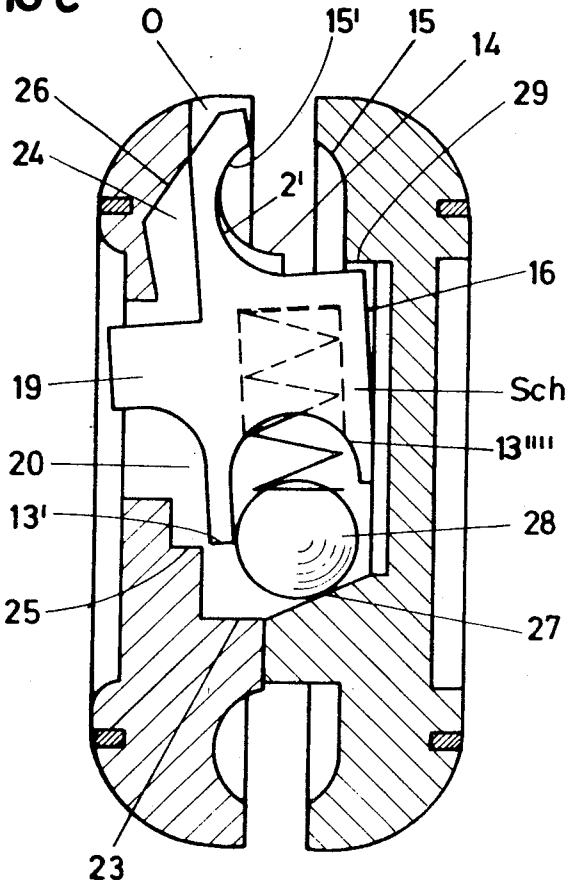
Figure 10D:
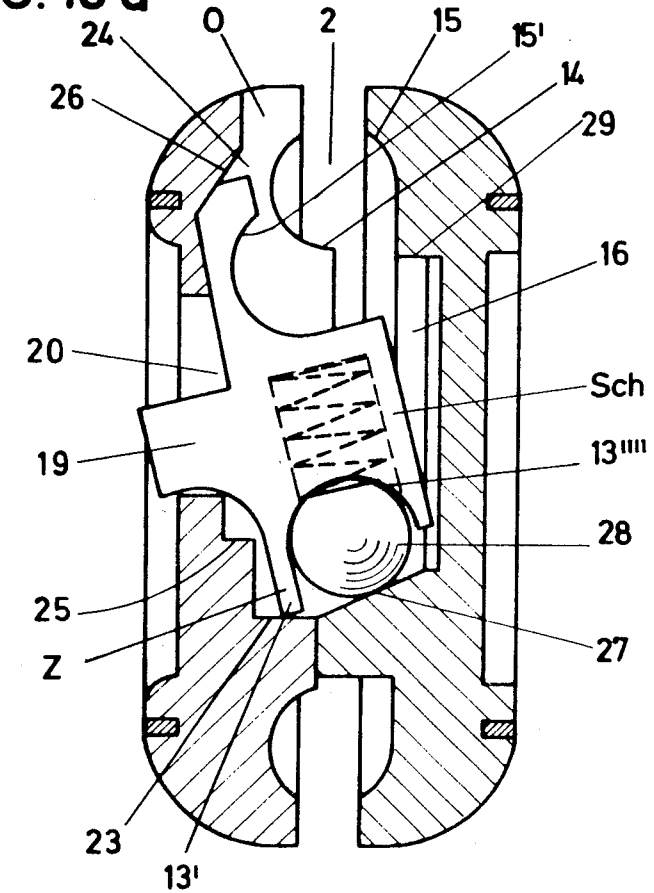
Figure 10E:
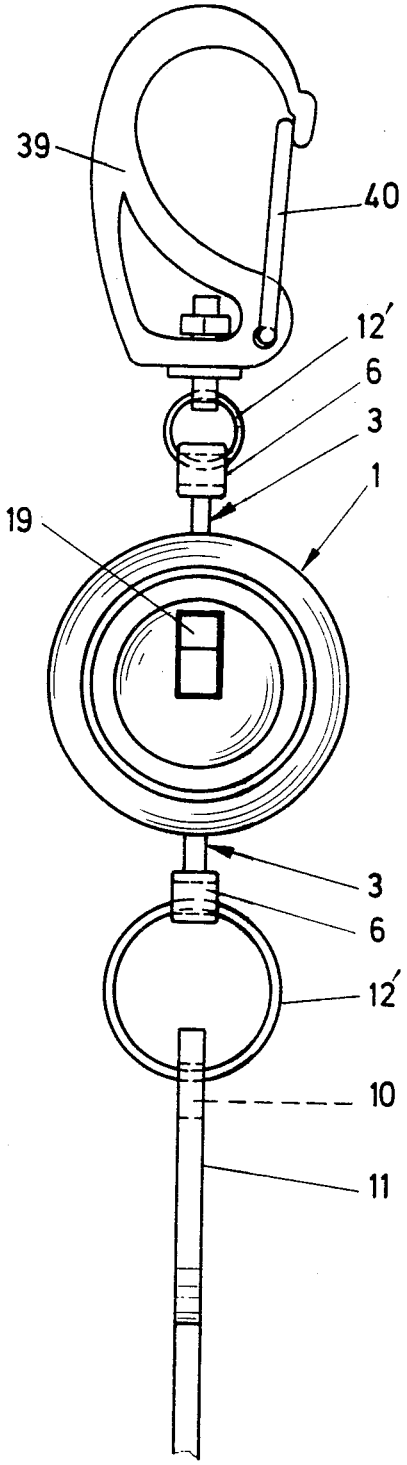
Figure 10F:
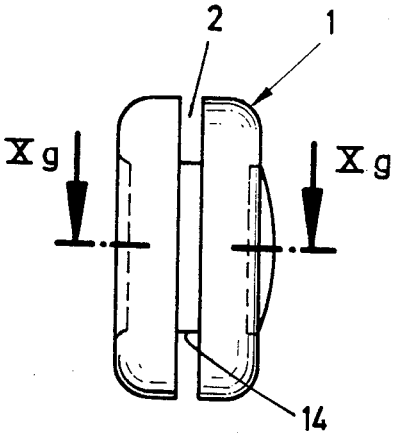
Figure 10G:
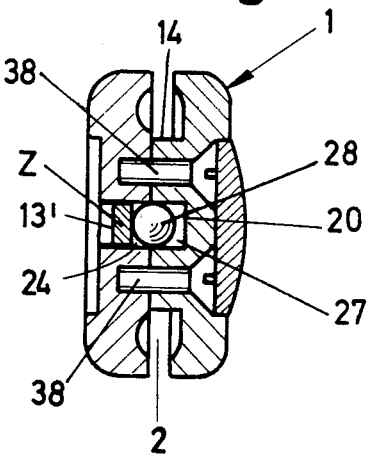
Figure 11:
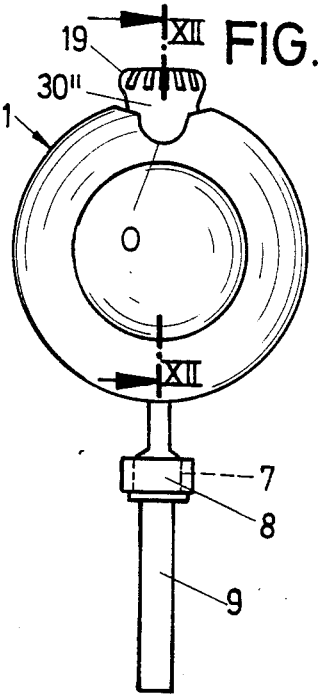
Figure 13:
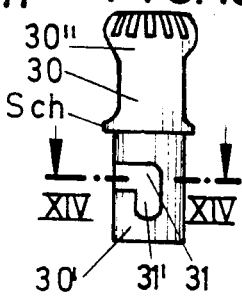
Figure 14:
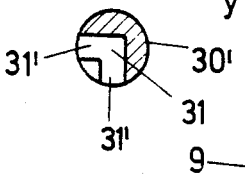
Figure 12:
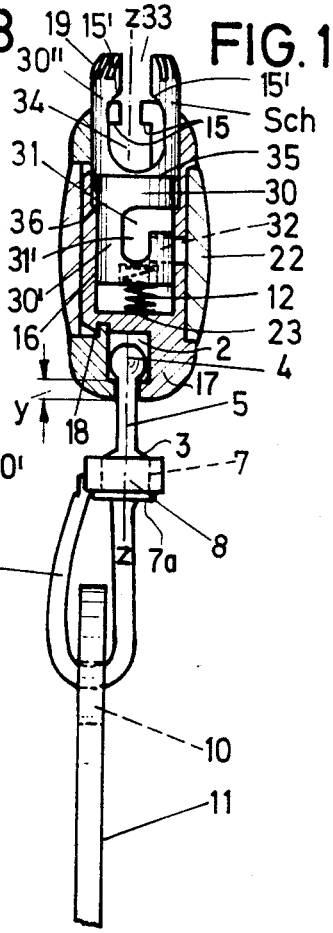
Figure 16:
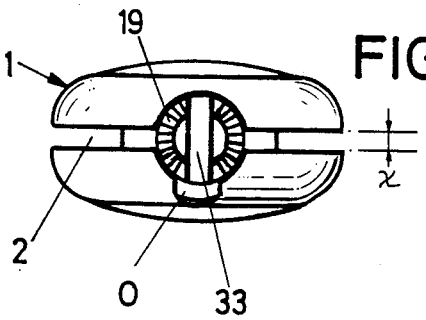
Figure 15:
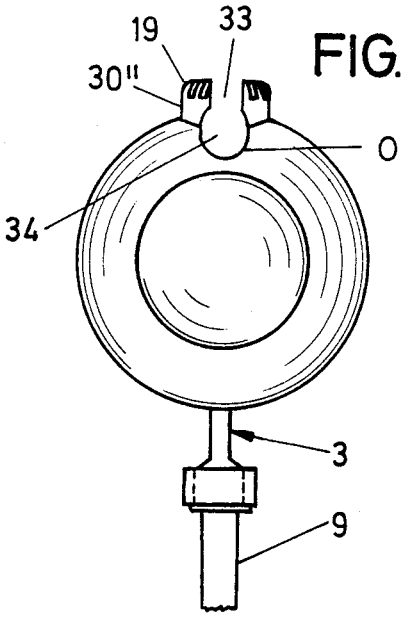

FIGS. 10*a*–10*d* are sectional views of different phases of operation of a further modified device with a tilt slide;

FIG. 10*e* is a front view of this device;

FIG. 10*f* is a side view thereof, seen from the left;

FIG. 10*g* is a sectional view along the line Xg—Xg of FIG. 10*f*;

FIG. 11 is a front view of the device according to the third embodiment with the slide in the closed position;

FIG. 12 is a sectional view along the line XII—XII of FIG. 11, likewise shown in the closed position;

FIG. 13 is an elevational view of the rotary slide alone of FIGS. 11 and 12;

FIG. 14 is a cross-sectional view taken along the line XIV—XIV of FIG. 13;

FIG. 15 is a front view of the device as in FIG. 11 but in the position in which the rotary slide is ready for an attachment of a new key-holder member;

FIG. 16 is a top view thereof of FIG. 15; and

Figure 17:
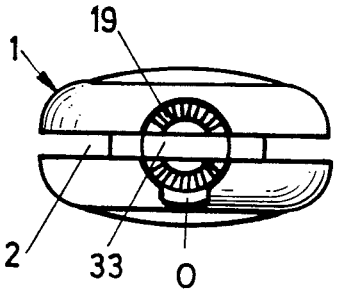

FIG. 17 is a top view of FIG. 11.

The device in accordance with the invention for attaching a bunch of keys is made of a disc 1 forming an open groove 2 at the peripheral edge of the disc extending 360 degrees with respect to the periphery of the disc. This groove continues towards the outside and a plurality of key-holder members 3 can be mounted therein. The groove 2 which is located approximately in the central plane z—z of the disc is undercut on both facing sides. The resultant widened region receives the ends of the key-holder members 3. These ends are formed as a ball head 4, the middle section of the holder members being developed as an arm 5 which at its other end has an eye 6 in the case of the embodiments 1–10*f*. In the third embodiment (FIGS. 11–15), the corresponding region is developed as a shaft 7 over which a sleeve 8 can be pushed, limited by a stop 7*a*. The sleeve sits on a loop 9 which extends from the shaft 7 on the side of the key-holder member 3 opposite the arm 5. The loop can be pulled through the key-ring opening 10 of a key 11 which is to be attached to the device. The key-holder member 3 of the third embodiment is made of suitably plasticized plastic.

The attaching of the key 11 in the other embodiments is effected by the use of a conventional key ring 12 which is pulled at one end through the eye 6 and at the other end passes through the key-ring opening 10 in the keys.

The peripheral region of the groove is selected in its inner width x so that only the arm 5 extends in a freely movable manner through it while, on the other hand, the ball head 4 is retained by the undercut. The arm has a length several times the length of the radial distance y of the narrowed region of the groove so that, in addition to turning around the central axis of the arm, a favorable degree of swinging in the plane of the groove is also provided.

The groove 2 of all embodiments is interrupted by an attachment-removal opening O for the ball heads 4. This opening can be closed by a slide Sch.

In the embodiment shown in FIGS. 1 to 5, the slide Sch is arranged for radial displacement in the disc 1. It is biased by a spring in the direction of closing. The spring bears the reference number 12.

The head 13 of the slide Sch can be pulled back up to or behind the bottom 14 of the groove. For this purpose the slide Sch has an actuating handle 19. After it is pulled back, the ball head 4 of the key-holder member 3 can also enter into the region of the groove which has now been freed and over which the attachment-removal opening O is located (see FIG. 3). The key-holder member, after being brought into this region, can be removed or a new one can be easily inserted. The insertion need not even be effected with use of the actuating handle 19; rather, the spherical head 4 of the key-holder member is merely pushed against the end surface 13' of the head of the slide until the ball has passed through the removal opening which corresponds to the maximum width of the groove. By displacing the ball head 4 in one or the other direction of curvature of the groove the ball head 4 drops behind the undercut flanks 15 of the groove 2 which hold it in place. The slide head then jumps back to in front of the attachment removal opening O, thus blocking it. The new key-holder member 3 has been reliably inserted.

A slide support 16 is contained in an insert part 17 which is clipped centrally and transversely into the disc 1. As done in the case of the third embodiment, it can be developed at the same time as a projection on one half of the disc and engage in the other disc half or else be associated with it in the manner so it connects the two halves forming the disc 1 to each other practically as a center piece. The clipping points are in all cases designated by 18. The insert piece is a structural part of point or rotational symmetry, as is the disc as well.

In the embodiments of FIGS. 1 to 10 the actuating handle 19 is developed as an arm section which projects transversely to the direction of movement of the slide. It engages through a shaft 20 which is provided in the insert part 17 and laterally adjoins the slide support 16 so as, passing through a guidance-limit slot 21 arranged in the same direction, to project free for actuation on the wide side of the disc there. The actual actuating surface is ribbed transversely to the direction of displacement of the slide. The length of the guidance-limit slot corresponds to the stroke of displacement for the release of the ball head.

At the level of the actuating handle 19 which emerges approximately in the central region of the wide side of the disc, the slide Sch forms a spring chamber 22 which is open towards the bottom. The upper end of the compression spring 12 extends into said chamber. The other end turn rests in a recess 23 which is formed by the insert part 17 or the disc 1.

While the device of the first embodiment provides for exclusively linear displacement of the slide, the linear path of displacement in the second embodiment, while retaining in principle the same construction, is furthermore interrupted by a step-induced transverse movement, which leads as a whole to a clear tilting of the slide.

The same parts are provided with the same reference numbers, without it being necessary to repeat this in the text.

The slide Sch in this case forms a passage cross-section 2' for the ball head 4. This passage cross-section 2' corresponds at least to the cross-section of the ball head and extends over towards the outside by at least one flank 15' of the slide Sch. The head 13 of the slide is therefore utilized on one side due to the provision of the passage cross section 2' as a groove-forming element and with its actual head 13 as a blocking element. The head 13 closes the removal opening O, which opening is formed here only by one half of the disc (in the left disc in FIGS. 7 and 8, the bottom disc in FIG. 10). This means that, in the closed position (FIG. 7), the ball heads 4 can slide unimpeded passing by the slide through the cross-section 2' without interruption within the groove 2. The slide Sch is located in a region of widening 24 in the cross section of the groove 2, namely on a radial channel 24 formed in the same disc half having the removal opening O. This widening channel 24 is directly below the attachment-removal opening O. The cross-sectional widening channel 24 is of such a size that the slide head 13, which forms a jaw extending practically into the groove 2 and the removal opening O can be retracted into the channel 24 so as to uncover and open the removal-attachment opening O so that the ball heads 4 of the key holder members 3 can pass from the groove 2 into and out of the opening O for removal, or in the reverse order for attachment of new key-holder members. This condition is shown in FIG. 8. As can be noted there, the jaw, which forms a jaw opening on the groove side, i.e., the head 13 of the slide Sch, frees the attachment-removal path. For the corresponding opening movement, the slide Sch is first of all displaced downwardly basically by a first linear movement. Its end 13' present there strikes against a blocking shoulder 25 of the insert part 17 which lies in the path of actuation. After this relatively short path of displacement, the removal opening O is, however, still not freed. Only upon the intentional pushing of the actuating handle 19 transverse to the displacement path is the slide brought into the tilted position shown in FIG. 8. The slide end 13' passes out of the range of action of the blocking shoulder 25. Only now, as a result of suitable dimensioning of the slide support 16, is further linear downward movement possible, which then leads to the complete freeing of the removal-attachment path.

An ascending deflection and respectively alignment bevel 26 which is directed opposite the tilting movement of the slide (at an acute angle alpha with respect to the central plan z—z of the disc surface) is coordinated to the head 13 of the slide Sch. This alignment bevel which essentially constitutes the top or roof of the cross-sectional widening 24 extends at an angle of about 45°. The corresponding surface 13''' of the head 13 is correspondingly beveled. A guide surface 27 aligned at the same angle is located at the side of the recess 23 on the bottom or remote end of the slide support 16 (FIG. 8). This region of the bottom receives a ball 28. The lower end of the slide spring 12 rests against the ball, centered by its spherical shape. The tilted position of the slide is supported at at least three points, namely on the bottom on the recess-bounding side edge **25*a* of the blocking shoulder 25, on the surface of the slide support 16 opposite the edge 25*a* and furthermore by the abutment of the actuating handle 19 against the lower edge 20*a* of the shaft 20**.

Figure 1:
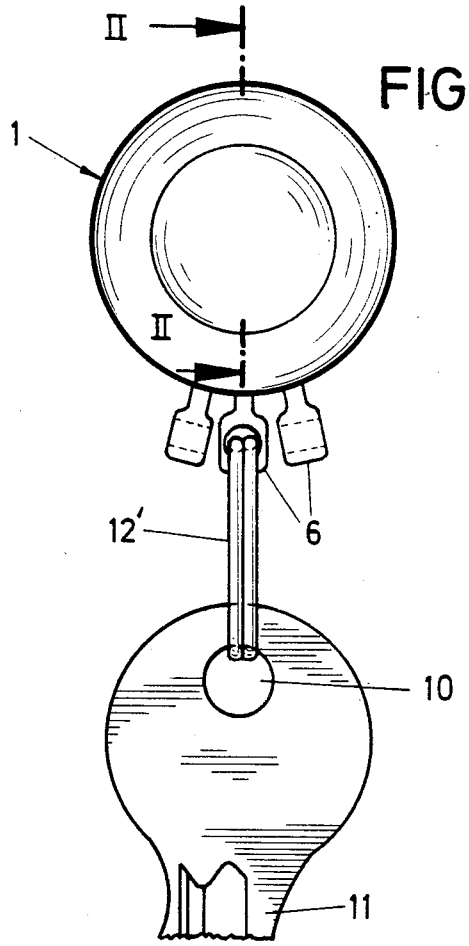
FIG. 1 is a front view of the device for a bunch of keys in accordance with the first embodiment.
Figure 2:
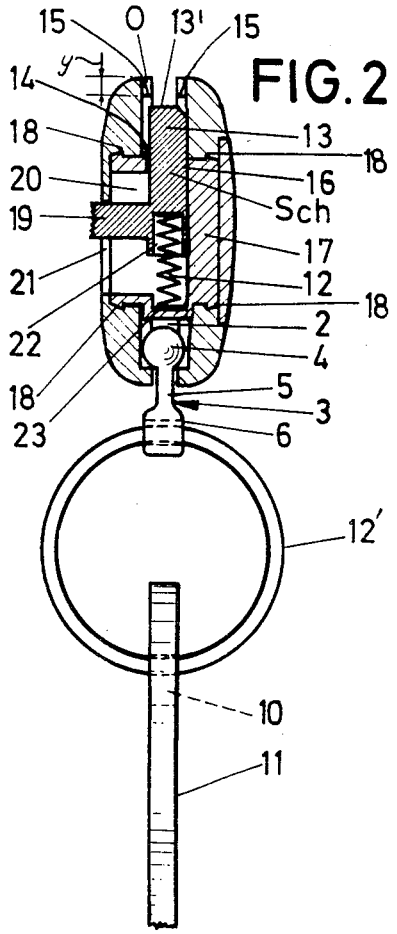
FIG. 2 is a cross-section along the line II—II of FIG. 1, shown in the closed position of the slide.
Figure 4:
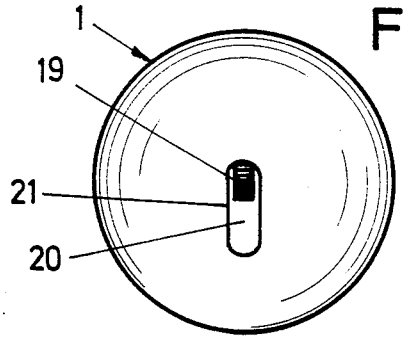
FIG. 4 is a rear view of the device of FIG. 2 shown in the closed position.
Figure 3:
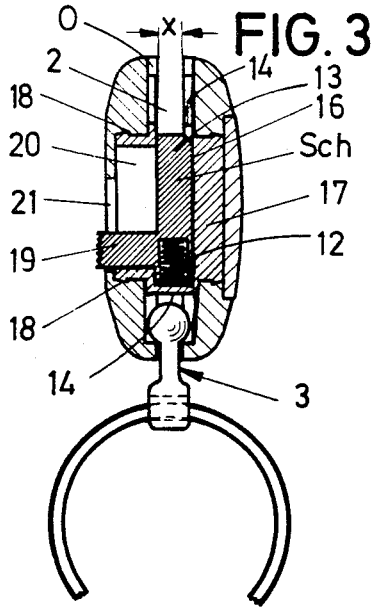
FIG. 3 is a view similar to FIG. 2 but in the open position of the slide.
Figure 5:
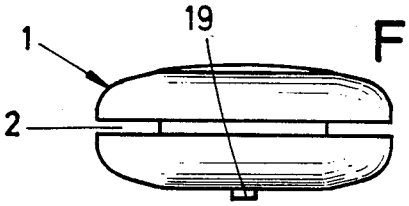
FIG. 5 is a top view of FIG. 1.
Figure 6:
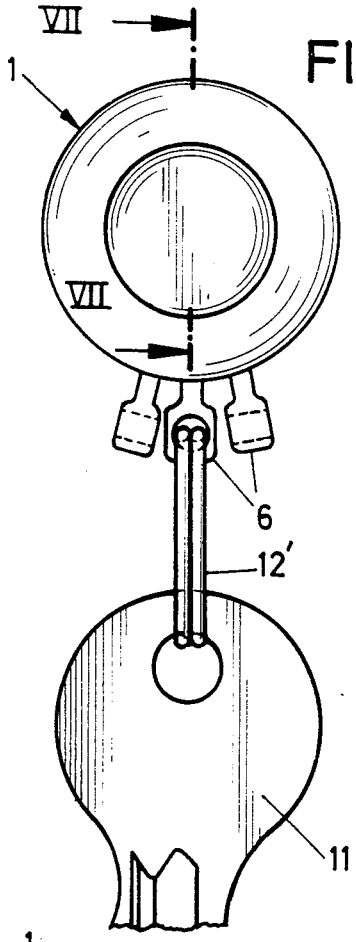
FIG. 6 is a front view of the device of the second embodiment.
Figure 7:
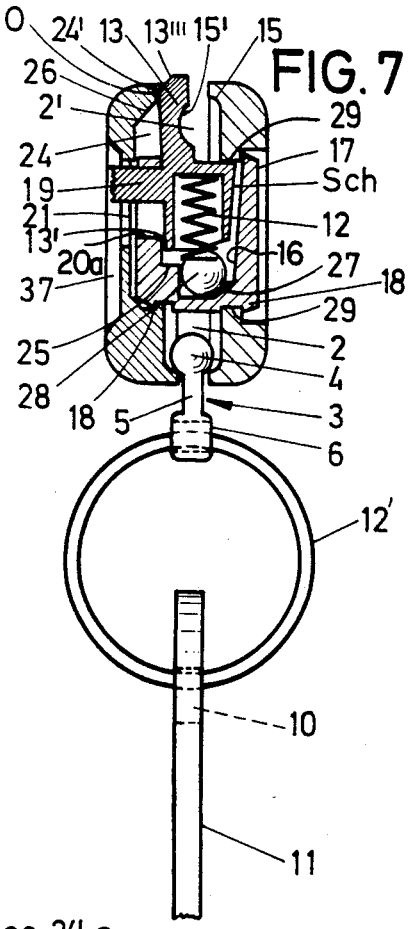
FIG. 7 is a section along the line VII—VII of FIG. 6, shown in the closed position.
Figure 9:
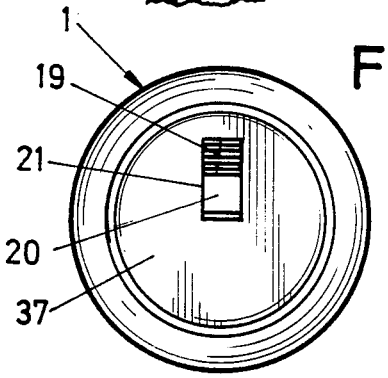
FIG. 9 is a rear view of FIG. 7.
Figure 8:
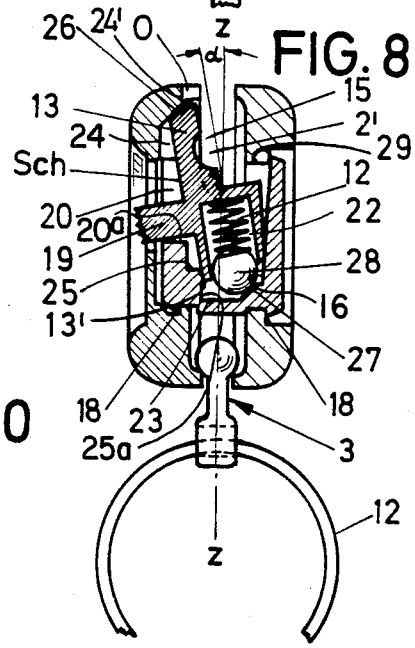
FIG. 8 shows this device in open position.

After releasing the slide, the spring 12 presses it again into the closed position shown in FIG. 7. As a result the alignment bevel 26 deflects the slide from its tilted position into the basic position proper for closing. Effecting the extended position is favored, furthermore, by the guiding surface 27 since it acts as control surface for the ball 28 which in this position has stepped up into the spring chamber 22. The ball slides down. As a limit stop for the closed position, use can be made of the actuating handle 19 which abuts against the upper edge of the guidance-limit slot 21. In the embodiment shown in FIGS. 6 to 10 the slide is furthermore itself used as a limit stop, its portion facing the groove 2 abutting against a blocking shoulder 29 of the disc 1. The shoulder 29 is formed here from the passage opening for the insert part 17. In this way, the slide Sch is supported on both sides so that there is no tendency to tilt so as for example to make the groove portion of reduced cross-section smaller. Abutment of the slide Sch against the disc is assured by the force of the spring 12.

In the case of the somewhat modified tilt-slide version in accordance with FIGS. **10*a*–10*g*, in principle there is the same course of motion as the previous embodiments only that here the ball 28, in the locked position, goes into contacting or almost contacting blocking position with respect to the slide Sch (see FIGS. 10*a* and 10*b*). The blocking shoulder 25 lies approximately at the height of the center of the ball. Its upper spherical half is in front of the blocking shoulder 25. As can be seen, the step flank 25' on the slide support is flush 13'' of the slide end 13' which is formed as a downwardly projecting tongue Z (FIG. 10*b*). The ball 28 is defined precisely between the flank 25 and the guiding surface 27. The ball 28 is thicker here than the diameter of the spring chamber 22. In order to permit the slide to undergo displacement and tilting movement the lower end 13'''' of the slide is concavely rounded and continues on the side of the handle 19 into the straight inner flank 13'' of the tongue Z. The cross-sectional widening channel 24 of the groove 2 is in this case also developed such that the support surface 24' in the removal opening O prevents deflection (tilting) of the slide Sch upon pulling in the direction of the keys. The undercut flank 15' is retained, blocking the removal opening O. Thus it is not possible for the key-holder member 3 to slide out of the open groove 2** which extends through to the outside.

Upon the exertion of pressure by a key-holder member 3 on the slide Sch, the slide is held on the blocking shoulder 25 by the ball 28 which rests against the tongue Z arranged on the slide side, the ball sliding under spring pressure of the slide spring 12 on the obliquely developed guiding surface 27 located opposite the slide. This prevents the slide from sliding back. By this feature, the deflection bevel 13''' of the slide remains within the region of the support surface 24' so that a deflection (tilting) of the slide and thus a freeing of the undercut 15' is not possible.

Upon actuation of the operating handle 19 by a slide-push force, the tongue Z of the slide is moved past the blocking shoulder 25. In this manner the support surface 24' serves as a pivot-point support. Upon sliding the slide further back, which is now possible, the deflection bevel 13''' of the slide comes into the region of the alignment bevel 26 of the disc 1 so that there is a slide-tilt movement of the slide (FIG. 10*c* to FIG. 10*d*). This results in a one-sided elimination of the blocking position of the undercut 15', which forms a continuation of the undercut flank 15, in the removal opening O in he blocking position of FIG. 10*a* and the essentially still effective blocking position thereof in FIGS. 10*b* and 10*c*, whereby now in FIG. 10*d* the removal opening O is unblocked. This permits the ball heads 4 to slide out or to be inserted in the opening O. The two disc halves are connected in this embodiment by two screws 38 which are arranged on the side of the slide Sch (FIG. 10*g*).

A key-holder member 3 is connected to a holding hook 39 (FIG. 10*e*), the hook opening of which is kept closed by a pivot member 40 which is held by the force of a spring in its basic position.

In the third embodiment (FIGS. 11 to 17) the slide Sch is developed as a rotary slide. This device can be actuated by a two-hand operation. The slide is here a pin 30 which is stepped down in its diameter in its central region. Its section 30' of smaller cross-section is seated with limited longitudinal displacement as well as limited rotation within the slide support 16 of the insert member 17, the slide support being formed with a round cross section corresponding to the cylindrical shape of the pin 30.

The outer section 30'' of larger cross section of the radially extending pin 30 which is arranged in the central plane z—z of the disc surface forms the actuating handle 19 in this embodiment. In order to increase the ease of grip, the grip surfaces are ribbed or fluted substantially radially with respect to the pin 30 as in the case of a hand setting knob of a watch.

This rotary slide is also biased by a compression spring 12 which extends on one end into the spring chamber 20 in the pin, the chamber 21 being formed in an axially central position. The other, bottom end of the spring 12 extends into the recess 23 in the insert member 17.

The displacement and rotation limits are obtained by a bayonet-closure-like locking recess 31 cut-out or formed in the region of the inner section 30' of the slide Sch. The locking recess 31 has a U-shaped slot profile on the periphery of the section 30'. The leg sections 31' of the U-slot which extend in the axial direction of the pin 30 make possible the axial displacement of the rotary slide with respect to the disc 1 and respectively with respect to the insert part 17 which primarily mounts it, while the horizontal connecting section of the U permits the radial displacement thereof. A radially inwardly directed control pin 32 extends from the insert part 17 into the U-slot 31. The control pin 32 is formed on a circular plate 22 which is simply clipped into a recess in the disc half which is formed here in one piece with the insert part 17.

The section 30'' of larger cross section of the pin 30 has a diametric undercut channel 33 which extends from the free end of the pin 30 and corresponds in its inner width to the width x of the narrowed region y of the groove 2. The flanks 15' of the undercut are aligned with the flanks 15 of the groove 2 in the position of FIG. 12. This channel 33 continues in a radially inward direction towards the inside of the disc into an opening 34 which extends in the same direction and in the closed position (FIG. 12) still leaves free a passage cross-section which in stepless fashion connects the cross-section of the groove 2. Accordingly, in this embodiment, also the key-holder members 3 can be moved in the closed position with free rotation and periphral sliding in the groove. This closed position is retained by the control pin 32 in one of the leg ends 31' of the slot 31.

The control pin 32 is then located in one of the two slot sections 31' of the slot 31 which are directed parallel to the axis. By pushing the pin 30 inwardly, the transverse horizontal connecting section of the slot reaches the control pin 32. The corresponding axial displacement is effected against the action of the spring 12. Brought into this position, the rotary slide can now be rotated and therefore brought into the position shown in FIGS. 15–16. This position is the position of readiness for attachment of a new key-holder member 3. In this position, namely, the ball head 4 of a key-holder member 3 can be inserted into the horizontal throat-like opening O which is transversely formed in one disc half, and which opening is now aligned with the opening 34, serving as sort of a sluice, of the rotary slide. In this position, all other key-holder members 3 are blocked against removal and falling out by the walls of the sections 30'' of the pin 30. By turning the pin, the new key-holder member 3 which has been inserted in the channel 34 is introduced into the groove 2 with the row of the other key-holder members 3 therein (see FIG. 17). The amount of rotation is 90°.

The limitation of the inward pushing of the rotary slide, if not caused already by its lower end, is caused by the shoulder 35 produced by the cross-section reduction, which shoulder strikes against an annular shoulder 36 of the insert part 17.

One or possibly also both wide surfaces of the disc can be provided with ornamental covers.

Both outer disc edges are transversely rounded so as to avoid sharp projections. In order to prevent unintended actuation of the handle 19, for instance by contact with other objects carried in a person's pocket or the like, the handle can be arranged countersunk in a dish-shaped recess 37 on the corresponding wide side of the disc as shown in FIG. 7. The recess, however, commences at a distance from the projecting handle 19 so that the edge of the handle close to the edge can still be conveniently gripped.

The disc is about the size of the handle of a key in which the key hole 10 is formed.

I claim:

1. In a device for forming a bunch of keys, having a centrally arranged disc, with individual key holder members adapted to extend from said disc, the key holder members each comprising an arm with a head, the heads being slidably mounted in an undercut groove in said disc, said groove opening towards the periphery of said disc, said groove has a removal opening constituting means through which said heads can be removed from and placed, respectively, into said groove in said disc, the improvement wherein said removal opening is formed as an enlarged, radially outwardly directed cross-section of said groove, a slide means for releasably closing said removal opening by reducing said cross-section to less than a cross-section of said heads, so as to prevent said heads from passing through said removal opening, said slide means is cooperatively formed with said groove so as to leave open a passage cross-section for passage of said heads with said arms, said passage cross-section for passage of said heads with said arms is formed when said slide means closes said removal opening.

2. The device as set forth in claim 1, wherein said disc is formed of two halves which are screwed together along a central plane of said disc.

3. The device as set forth in claim 1, wherein said heads are balls.

4. The device as set forth in claim 1, wherein said groove in said disc extends 360 degrees with respect to the periphery of the disc and is formed such that said heads are slideable completely around said groove 360 degrees and passing by said removal opening through said passage cross-section when said slide means closes said removal opening.

5. The device as set forth in claim 4, wherein said heads are balls.

6. The device as set forth in claim 1, wherein said slide means is substantially radially displaceably mounted in said disc and has an exposed operating handle at a wide side of said disc in a central region of said disc.

7. The device as set forth in claim 6, wherein said wide side of said disc is formed with a dish-shaped recess, a free end of said operating handle is countersunk in said dish-shaped recess.

8. The device as set forth in claim 6, further comprising an insert part is clipped transversely into said disc, said insert part forms a sliding support against which said slide means slides.

9. The device as set forth in claim 6, further comprising means for spring biasing said slide means into a position closing said removal opening.

10. In a device for forming a bunch of keys, having a centrally arranged disc, with individual key holder members adapted to extend from said disc, the key holder members each comprising an arm with a head, the heads being slidably mounted in an undercut groove in said disc, said groove opening towards the periphery of said disc, said groove has a removal opening constituting means through which said heads can be removed from and placed, respectively, into said groove in said disc, the improvement wherein said removal opening is formed as an enlarged, radially outwardly directed cross-section of said groove, a slide means for releasably closing said removal opening by reducing said cross-section to less than a cross-section of said heads, so as to prevent said heads from passing through said removal opening, said slide means is cooperatively formed with said groove so as to leave open a passage cross-section for passage of said heads with said arms, said groove has a portion widening in cross section, said slide means is disposed in a vicinity of said widening portion of said groove, and said slide means forms a jaw portion extending into said groove and defining a jaw opening forming a partial section of said groove.

11. In a device for forming a bunch of keys, having a centrally arranged disc, with individual key holder members adapted to extend from said disc, the key holder members each comprising an arm with a head, the heads being slidably mounted in an undercut groove in said disc, said groove opening towards the periphery of said disc, said groove has a removal opening constituting means through which said heads can be removed from and placed, respectively, into said groove in said disc, the improvement wherein said removal opening is formed as an enlarged, radially outwardly directed cross-section of said groove, a slide means for releasably closing said removal opening by reducing said cross-section to less than a cross-section of said heads, so as to prevent said heads from passing through said removal opening, said slide means is cooperatively formed with said groove so as to leave open a passage cross-section for passage of said heads with said arms, said slide means is substantially radially displaceably mounted in said disc and has an exposed operating handle at a wide side of said disc in a central region of said disc, said disc is formed with a blocking shoulder spaced remotely from and substantially facing said removal opening, said slide means is mounted in said disc tiltable over said blocking shoulder, upon a substantially radially inward pull-back movement of said slide means.

12. The device as set forth in claim 11, wherein said slide means has a head operatively closing said removal opening and an alignment incline on said head, said disc is formed with a deflection incline forming a widening portion of said groove, said alignment incline is slidable on said deflection incline during said pull-back movement effecting said tilting movement of said slide means.

13. The device as set forth in claim 12, wherein said disc is formed with a recess and a ball guiding surface adjacent to said recess spaced remotely from and substantially facing said removal opening, a ball is disposed in said recess and engages said ball guiding surface, means for spring biasing said slide means into said position closing said removal opening, a rear end of said spring biasing means rests against said ball.

14. The device as set forth in claim 13, wherein said ball guiding surface extends obliquely downwardly to said recess, said slide means is formed with a rear slide end adjacent said blocking shoulder, said blocking shoulder together with said rear slide end lie at approximately the height of the center of the ball in said position closing said opening.

15. The device as set forth in claim 14, wherein said rear slide end is formed as a tongue, said disc forms a step having a substantially radially aligned flank extending from said blocking shoulder and partly defining said recess, said flank extends substantially in a common plane as an inner flank of said rear slide end in said position of closing said opening.

16. The device as set forth in claim 15, wherein said rear slide end of said slide means adjacent said inner flank thereof is formed with a spherical shape receiving said ball in an inward and tilted position of said slide means with said head freeing said removal opening.

17. The device as set forth in claim 14, wherein said disc is formed of two halves which are screwed together along a central plane of said disc.

18. In a device for forming a bunch of keys, having a centrally arranged disc, with individual key holder members adapted to extend from said disc, the key holder, members each comprising an arm with a head, the heads being slidably mounted in an undercut groove in said disc, said groove opening towards the periphery of said disc, said groove has a removal opening constituting means through which said heads can be removed from and placed, respectively, into said groove in said disc, the improvement wherein said removal opening is formed as an enlarged, radially outwardly directed cross-section of said groove, a slide means for releasably closing said removal opening by reducing said cross-section to less than a cross-section of said heads, so as to prevent said heads from passing through said removal opening, said slide means is cooperatively formed with said groove so as to leave open a passage cross-section for passage of said heads with said arms, said slide means is substantially radially displaceably mounted in said disc and has an exposed operating handle at a wide side of said disc in a central region of said disc, said groove has a portion widening in cross section, said slide means is disposed in a vicinity of said widening portion of said groove, and said slide means forms a jaw portion extending into said groove and defining a jaw opening forming a partial section of said groove.

19. The device as set froth in claim 18, wherein said heads are balls.

20. In a device for forming a bunch of keys, having a centrally arranged disc, with individual key holder members adapted to extend from said disc, the key holder members each comprising an arm with a head, the heads being slidably mounted in an undercut groove in said disc, said groove opening towards the periphery of said disc, said groove has a removal opening constituting means through which said heads can be removed from and placed, respectively, into said groove in said disc, the improvement wherein said removal opening is formed as an enlarged, radially outwardly directed cross-section of said groove, a slide means for releasably closing said removal opening by reducing said cross-section to less than a cross-section of said heads, so as to prevent said heads from passing through said removal opening, said slide means is cooperatively formed with said groove so as to leave open a passage cross-section for passage of said heads with said arms, said slide means in cooperation with said groove forms said passage cross-section corresponding at least to said cross-section of said heads, said passage cross-section enabling said heads to pass by said slide means in said groove, said slide means has at least one flank which extends over part of said passage cross-section towards the periphery of said disc providing said above-mentioned closing of said removal opening.

21. The device as set forth in claim 20, wherein said heads are balls.

22. In a device for forming a bunch of keys, having a centrally arranged disc, with individual key holder members adapted to extend from said disc, the key holder members each comprising an arm with a head, the heads being slidably mounted in an undercut groove in said disc, said groove opening towards the periphery of said disc, said groove has a removal opening constituting means through which said heads can be removed from and placed, respectively, into said groove in said disc, the improvement wherein said removal opening is formed as an enlarged, radially outwardly directed cross-section of said groove, a slide means for releasably closing said removal opening by reducing said cross-section to less than a cross-section of said heads, so as to prevent said heads from passing through said removal opening, said slide means is cooperatively formed with said groove so as to leave open a passage cross-section for passage of said heads with said arms, said passage cross-section for passage of said heads with said arms is formed when said slide means closes and opens said removal opening, respectively.

23. The device as set forth in claim 22, wherein said heads are balls.

* * * * *